United States Patent [19]

Kregoski

[11] 4,148,198

[45] Apr. 10, 1979

[54] REFRIGERATION CHARGING AND SEALING DEVICE

[76] Inventor: Robert S. Kregoski, 15120 Amber Ct., Plymouth, Mich. 48170

[21] Appl. No.: 730,588

[22] Filed: Oct. 7, 1976

[51] Int. Cl.[2] ..... F25B 45/00

[52] U.S. Cl. ..... 62/292; 62/77; 62/149

[58] Field of Search ..... 62/292, 77, 149; 222/450; 29/422; 72/454, 112; 100/289

[56] References Cited

U.S. PATENT DOCUMENTS

| | | | |
|---|---|---|---|
| 2,181,854 | 11/1939 | Anderson et al. | 62/292 |
| 2,273,213 | 2/1942 | McCloy | 62/292 |
| 2,430,995 | 11/1947 | Roos | 29/422 |
| 3,145,465 | 8/1964 | Coolidge, Jr. et al. | 29/422 |
| 3,795,262 | 3/1974 | Post | 62/77 |
| 3,813,893 | 6/1974 | Gemender et al. | 62/292 |
| 3,842,652 | 10/1974 | Yonezawa et al. | 100/289 |
| 3,976,110 | 8/1976 | White | 62/77 |

*Primary Examiner*—Lloyd L. King

[57] ABSTRACT

A capillary tube of long length insertable into a distal end of a process tube from a compressor of a refrigeration unit has a Schraeder fitting attached to a distal end of the capillary tube to charge the compressor, after charging the compressor the proximal tip of the capillary tube can be cut from the capillary tube and fitting and the capillary tube tip can be inserted into a swage block which forms a capillary sealing anvil and a handle with a threaded shaft and capillary tip sealing tip can be threaded into a perpendicular shaftway to seal the capillary, thus reducing the number of fittings that a refrigeration unit compressor charger must carry from refrigeration unit to refrigeration unit.

5 Claims, 4 Drawing Figures

REFRIGERATION CHARGING AND SEALING DEVICE

I have invented a new and novel refrigeration charging and sealing device. My device will reduce the need for a large variety of fittings for filling and charging refrigeration devices. My device will permit the use of one unit to service a large plurality of refrigeration units with a minimal consumption of materials.

My invention can be understood in view of the accompanying figures.

Figure 1:
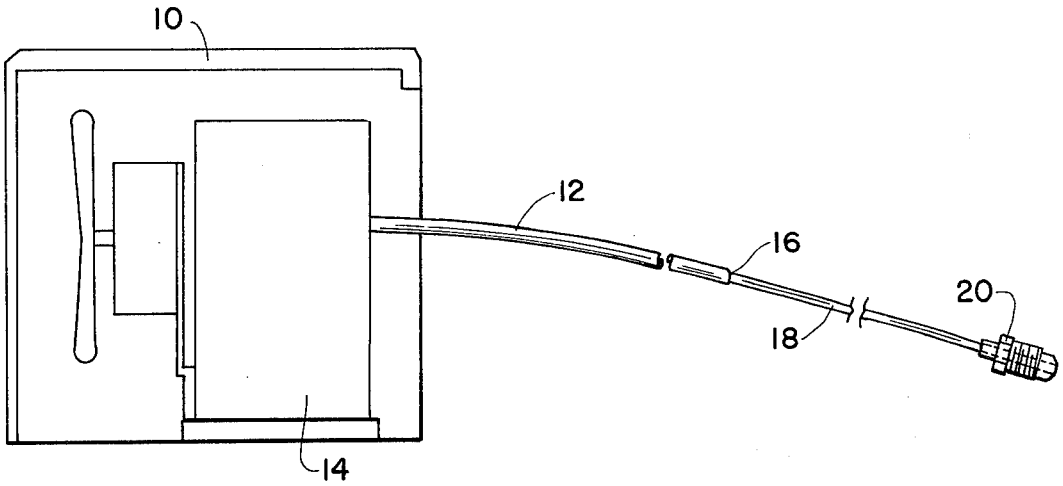
FIG. 1 is a perspective view of part of my device prepared for charging a refrigeration unit.

With regard to FIG. 1, a refrigeration unit 10 having a process tube 12 extending from the compressor 14 can have the compressor 14 charged with refrigerating fluid by inserting in the distal opening 16 of the process tube 12 a long capillary tube 18 of approximately 0.125 inch outside diameter and silver brazing the end of the capillary tube 18 to the process tube 12. The capillary tube 18 can be of long length with a Schraeder fitting 20 at the distal end of the capillary tube 18 for connection to the charging device.

After charging the refrigeration unit 10 the long capillary tube 18 is no longer needed but the process tube must be sealed and therefore the proximal end of the capillary tube 18 can be severed from the length of the capillary tube 18, thereby retaining a long length of capillary tube connected to a standard Schraeder fitting 20 which can then be reused for recharging many other refrigeration units such as 10.

Figure 2:
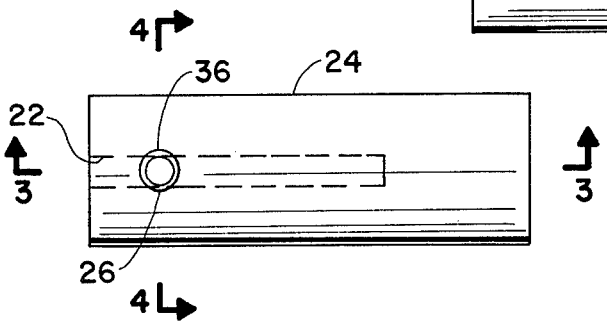
FIG. 2 is a top view of a swage block for use in conjunction with the components of FIG. 1.
Figure 4:
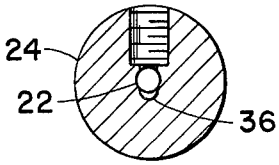
FIG. 4 is the section of the swage block of FIG. 2 taken in the plane 4—4.
Figure 3:
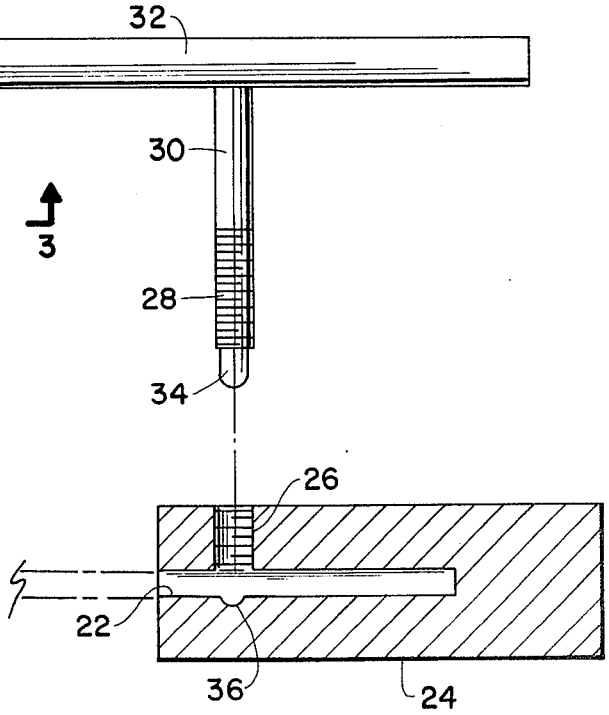
FIG. 3 is a side view in partial section of the swage block of FIG. 2 with the swaging tool about to be inserted in the swage block.

With regard to FIGS. 2, 3, and 4, after the proximal end of the capillary tube 18 has been severed from the length of the capillary tube 18 the capillary tube proximal end must be sealed. If approximately four inches of capillary tube 18 are allowed to remain attached to the process tube 12 the capillary tube tip 18 can be inserted into a shaftway 22 in a swage block 24 in which a perpendicular threaded shaft 26 has been formed in which the threaded end 28 of a shaft 30 can be inserted and rotated by a handle 32 in order to drive a rounded tip 34 against the capillary tube 18 and against the anvil base 36 formed in the swage block 24 to seal the capillary tube 18. This sealing operation can be carried out at several points along the length of the capillary tube tip 18 to insure proper sealing of the capillary tube 18.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A refrigeration charging and sealing device, comprising:

a process tube of a refrigeration unit, a capillary tube insertable in a distal end of the process tube, means of sealing the capillary tube into the process tube, and means of connecting a distal end of the capillary tube to a compressor charging device.

2. The device of claim 1, wherein the means of sealing the capillary tube to the process tube is silver brazing.

3. The device of claim 2, wherein the means of connecting the distal end of the capillary tube to the charging device comprises a Schraeder fitting attached to the distal end of the capillary tube.

4. The device of claim 3, further comprising:

a swage block forming a shaftway mountable over a proximal tip of the capillary tube after the proximal tip of the capillary tube has been severed from the capillary tube, and means of sealing the proximal end of the capillary tube within the swage block.

5. The device of claim 4, wherein the means of sealing the capillary tube within the swage block comprises:

the swage block forming a perpendicular threaded shaftway, a shaft forming a threaded lower portion engageable with the threaded shaftway and forming a tube sealing tip engageable with the capillary tube tip, a portion of the capillary tube receiving shaftway under the threaded shaftway forming a capillary tube sealing anvil, and a handle attached to an upper end of the shaft, whereby the threaded portion of the shaft may be forceably engaged with the threaded shaftway driving the capillary tube sealing tip into engagement with the capillary tube tip and driving the capillary tube tip into engagement with the anvil to seal the capillary tube tip.

* * * * *